US006550548B2

(12) United States Patent
Taylor

(10) Patent No.: US 6,550,548 B2
(45) Date of Patent: Apr. 22, 2003

(54) ROTARY STEERING TOOL SYSTEM FOR DIRECTIONAL DRILLING

(76) Inventor: Kyle Lamar Taylor, 17718 Surreywest La., Spring, TX (US) 77379

( * ) Notice: Subject to any disclaimer, the term of this patent is extended or adjusted under 35 U.S.C. 154(b) by 0 days.

(21) Appl. No.: 09/785,124

(22) Filed: Feb. 16, 2001

(65) Prior Publication Data

US 2002/0112892 A1 Aug. 22, 2002

(51) Int. Cl.[7] ..... E21B 7/04

(52) U.S. Cl. ..... 175/45; 175/317; 175/324; 175/74

(58) Field of Search ..... 175/40, 45, 61, 175/73, 74, 317, 324, 325, 325.3

(56) References Cited

U.S. PATENT DOCUMENTS 4,948,925 A * 8/1990 Winters et al.
5,131,479 A 7/1992 Boulet et al.
5,547,031 A * 8/1996 Warren et al.
5,553,678 A * 9/1996 Barr et al.

* cited by examiner

*Primary Examiner*—Roger Schoeppel
(74) *Attorney, Agent, or Firm*—Michael Jolly

(57) ABSTRACT

A rotary steering apparatus including a drill string, a drill bit, a main body connected at one end to the drill string and at another end to the drill bit, a sleeve extending around the main body such that the main body is freely rotatable within the sleeve, and a locking member affixed to the main body and interactive with the sleeve. The sleeve has at least one protruding pad extending outwardly therefrom so as to bear against a well bore. The locking member serves to lock the sleeve relative to the main body such that the sleeve rotates correspondingly with a rotation of the main body. The locking member locks the sleeve onto the main body relative to an increased flow rate of fluid through the interior passageway of the main body. The locking member includes a flipper pivotally connected to the main body so as to extend into the longitudinal passageway and a spring resiliently connected to the flipper so as to urge the flipper into the interior passageway with a desired spring rate.

20 Claims, 8 Drawing Sheets

ROTARY STEERING TOOL SYSTEM FOR DIRECTIONAL DRILLING

BACKGROUND OF THE INVENTION

1. Field of the Invention

The present invention relates to methods and apparatus for drilling wells. More particularly, the present invention relates to a rotary steerable drilling system that can be connected directly to a rotary drill string so as to allow for selective control of the direction of drilling within a well bore.

2. Description of Related Art

An oil or gas well often has a subsurface section that is drilled directionally, i.e., inclined at an angle with respect to the vertical and with the inclination having a particular compass heading or azimuth. Although wells having deviated sections may be drilled at any desired location, such as for "horizontal" borehole orientation or deviated branch bores from a primary borehole, for example, a significant number of deviated wells are drilled in the marine environment. In such case, a number of deviated wells are drilled from a single offshore production platform in a manner such that the bottoms of the boreholes are distributed over a large area of a producing horizon over which the platform is typically centrally located and wellheads for each of the wells are located on the platform structure.

Whether well drilling is being done on land or in a marine environment, there exists a present need in well drilling activities for extended reach drilling.

A typical procedure for drilling a directional borehole is to remove the drill string and drill bit by which the initial, vertical section of the well was drilled using conventional rotary drilling techniques, and run in at the lower end of the drill string a mud motor having a bent housing which drives the bit in response to circulation of drilling fluid. The bent housing provides a bend angle such that the axis below the bend point, which corresponds to the rotation axis of the bit, has a "toolface" angle with respect to a reference, as viewed from above. The toolface angle, or simply "toolface", establishes the azimuth or compass heading at which the deviated borehole section will be drilled as the mud motor is operated. After the toolface has been established by slowly rotating the drill string and observing the output of various orientation devices, the mud motor and drill bit are lowered, with the drill string non-rotatable to maintain the selected toolface, and the drilling fluid pumps, "mud pumps", are energized to develop fluid flow through the drill string and mud motor, thereby imparting rotary motion to the mud motor output shaft and the drill bit that is fixed thereto. The presence of the bend angle causes the bit to drill on a curve until a desired borehole inclination has been established. To drill. a borehole section along the desired inclination and azimuth, the drill string is then rotated so that its rotation is superimposed over that of the mud motor output shaft, which causes the bend section to merely orbit around the axis of the borehole so that the drill bit drills straight ahead at whatever inclination and azimuth have been established. If desired, the same directional drilling techniques can be used to curve the wellbore to horizontal and then extend it horizontally into or through the production zone. Measurement-while-drilling "MWD" systems commonly are included in the drill string above the mud motor to monitor the progress of the borehole being drilled so that corrective measures can be instituted if the various borehole parameters indicate variance from the projected plan.

Various problems can arise when sections of the well are being drilled with the drill string non-rotatable and with a mud motor being operated by drilling fluid flow. The reactive torque caused by operation of a mud motor can cause the toolface to gradually change so that the borehole is not being deepened at the desired azimuth. If not corrected, the wellbore may extend to a point that is too close to another wellbore, the wellbore may miss the desired "subsurface target", or the wellbore may simply be of excessive length due to "wandering". These undesirable factors can cause the drilling costs of the wellbore to be excessive and can decrease the drainage efficiency of fluid production from a subsurface formation of interest. Moreover, a non-rotating drill string may cause increased frictional drag so that there is less control over the "weight on bit" and the rate of drill bit penetration can decrease, which can result in substantially increased drilling costs. Of course, a non-rotating drill string is more likely to get stuck in the wellbore than a rotating one, particularly where the drill string extends through a permeable zone that causes significant build up of mud cake on the borehole wall.

In the past, various U.S. patents have issued relative to such rotary steering systems for directional drilling. For example, U.S. Pat. No. 6,092,610, issued on Jul. 25, 2000 to Kosmala et al., describes an actively controlled rotary steerable drilling system having a tool collar rotated by a drill string during well drilling. A bit shaft has an upper portion within the tool collar and a lower end extending from the collar and supporting a drill bit. The bit shaft is omnidirectionally pivotally supported intermediate of its upper and lower ends by a universal joint within the collar and is rotatably driven by the collar. To achieve controlled steering of the rotating drill bit, orientation of the bit shaft relative to the tool collar is sensed and the bit shaft is maintained geostationary and selectively axially inclined relative to the tool collar during drill string rotation by rotating it about the universal joint by an offsetting mandrel that is rotated counter to collar rotation and at the same frequency of rotation.

U.S. Pat. No. 6,109,372, issued on Aug. 29, 2000, to Dorel et al., describes another rotary steerable drilling system having a tubular rotary tool collar having rotatably mounted thereabout a substantially non-rotatable sliding sleeve incorporating a plurality of elastic coupling members to maintain the sliding sleeve in coupled rotation with the borehole wall during drilling. An offsetting mandrel is supported within the tool collar by a knuckle joint for pivotable movement and is rotatably driven by the tool collar and has a lower end extending from the collar and adapted to support a drill bit. To achieve controlled steering of the rotating drill bit, orientation of the drilling tool is sensed by navigation sensors and the offsetting mandrel is maintained geostationary and selectively axially inclined relative to the tool collar by orienting it about the knuckle joint responsive to navigation sensors.

U.S. Pat. No. 5,131,479, issued on Jul. 21, 1992 to Boulet et al., describes a rotary drilling device including a means for adjusting the azimuth angle of the path of the drilling tool. The means for adjusting the azimuth angle includes a tubular body having a radially projecting bearing blade and mounted rotatably on the set of rods. A remotely actuable junction makes it possible to fix the set of rods and the tubular body relative to one another in terms of rotation in its active position. In the inactive position of the junction means, the set of rods is freely rotatable within the tubular body which is held immobile in terms of rotation in the drill hole by means of the bearing blade. The bearing blade is placed in the drill hole in an angular orientation making it possible to adjust the azimuth angle in the desired direction.

It is an object of the present invention to provide a rotary steering tool which facilitates directional drilling.

It is another object of the present invention to provide a rotary steering tool which allows the use of mudflow to allow for adjustment of the desired angle of directional drilling.

It is a further object of the present invention to provide a rotary steering tool system which is able to replace conventional mud-motors.

It is a further object of the present invention to provide a rotary steering tool which allows the rotary action of the drill string to drive the bit.

It is a further object of the present invention to provide a rotary steering tool which is relatively inexpensive in comparison with other steering tools.

It is a further object of the present invention to provide a rotary steering tool which reduces "lost-in-hole" risks.

It is a further object of the present invention to provide a rotary steering tool which is relatively small in size and compact for easy transportation.

It is a further object of the present invention to provide a rotary steering tool which reduces rig time with fewer trips out of the hole.

It is a further object of the present invention to provide a rotary steering tool which provides the ability to locate critical measurement devices close to the bit so as to identify pay zones prior to drilling through the zone.

It is still a further object of the present invention to provide a rotary steering tool which allows for the ability to drill with the casing since the rotary steering tool and the drill bit can remain down hole.

These and other objects and advantages of the present invention will become apparent from a reading of the attached specification and appended claims.

BRIEF SUMMARY OF THE INVENTION

The present invention is a rotary steering apparatus comprising a main body having an interior passageway extending longitudinally therethrough, a sleeve extending around the main body such that the main body is rotatable within the sleeve, and a locking member affixed to the main body. The sleeve has at least one protruding pad extending outwardly of an exterior surface thereof. The locking member is engageable with the sleeve relative to a flow rate of mud through the interior passageway of the main body such that the sleeve is fixed relative to the main body. The main body has a drill string connection at a top end thereof and a drill bit connection at a bottom end thereof. The drill string is connected to the top end of the main body. The drill bit is connected to the opposite end of the main body. The drill string is drivingly connected to the main body so as to rotate the main body so as to drive the drill bit. The sleeve has an interior opening. The main body extends through this interior opening. The sleeve has a hole formed therein opening toward the interior opening. The locking member is engageable with this hole. The hole is radially aligned with the protruding pad. The sleeve has three protruding pads formed on an exterior surface thereof. Each of the protruding pads is evenly spaced from an adjacent protruding pad. In particular, one of the three protruding pads extends outwardly further from the exterior surface than the other of the protruding pads. The hole is aligned with the largest of the protruding pads.

The locking member comprises a flipper member extending pivotally into the interior passageway, a spring connected to the flipper so as to resiliently urge the flipper into the interior passageway, and a rod connected to the flipper so as to move in correspondence with a pivotable movement of the flipper. The rod is engageable with the sleeve so as to fix the sleeve to the main body such that the sleeve rotates correspondingly with a rotation of the main body. The main body has a channel extending transverse to the longitudinal passageway and opens thereto. This sleeve has a hole formed therein which faces the main body. The rod is movable so as to engage the hole. A retaining housing is affixed within the channel. The flipper is pivotally connected to the retaining housing. The spring is positioned within the retaining housing. The rod extends through the retaining housing so as to have an end facing the sleeve. The rod has a diameter less than a diameter of the hole. The flipper urges the rod outwardly of the retaining housing so as to enter the hole. The spring has a predetermined spring rate. The flipper is interactive with the spring such that a desired mudflow rate causes the flipper to overcome the spring rate so as to urge the rod outwardly of the main body.

DETAILED DESCRIPTION OF THE INVENTION

Figure 1:
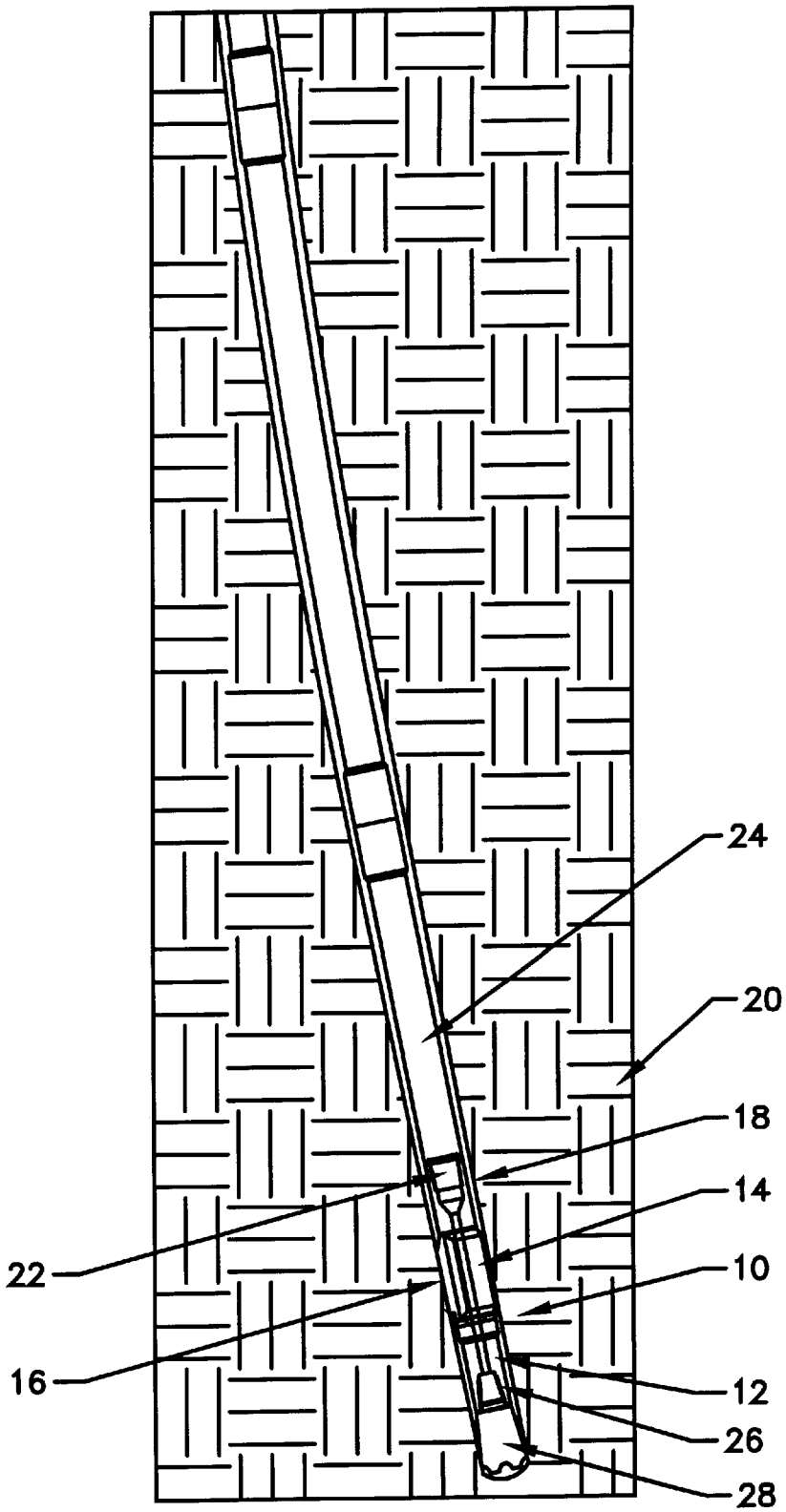
FIG. 1 is a diagrammatic illustration of the present invention as used downhole in a drilling operation.

Referring to FIG. 1, there is shown at 10 the rotary drilling apparatus in accordance with the teachings of the present invention. The rotary drilling apparatus 10 includes a main body 12 freely rotatable within a sleeve 14. The sleeve 14 has a protruding pad 16 bearing against a surface of the well bore 18 within the earth 20. The main body 12 is connected at its top end 22 to the drill string 24. The main body 12 is connected at its bottom end 26 to a drill bit 28. As can be seen, the drill string 24 is formed of several couplings which are extending through the earth 20 at a desired drilling angle. A Measurement-While-Drilling (MWD) tool is located in the drill string 24 very close to the rotary steering apparatus 10. The MWD and the rotary steering apparatus are aligned together so as to allow the drilling crew at the surface to orient the rotary steering apparatus 10 in a desired direction. The rotary steering apparatus is designed so as to lock the protruding pad 16 by increasing the rate of mudflow. During the drilling process, the MWD tool will indicate the direction of the drilling bit 28. If the bit is drilling off course, the driller will reduce the drill string rotation rate increase the flow to the assigned rate that was determined prior to drilling the well and using the MWD tool to orientate in the desired direction. Once the MWD orientation is set, the drill string rotation rate will be zero, the rate of mudflow will be reduced, and drilling can be reduced by taking periodic readings from the MWD tool to remain on course.

The rotary steering apparatus 10 is approximately thirty inches in length and is capable of being manufactured as small as 2⅞ inches of outside diameter to any larger size as required. The rotary steering apparatus is designed with the independent sleeve 14 which rotates freely from the drill string 24. The sleeve 14 is preferably manufactured with three protruding pads spaced 120 degrees apart. One of the three protruding pads 16 extends slightly outwardly of the outside diameter of the drill bit. This will allow the protruding pad 16 to bear against the well bore 18 and provide a constant push to the drill bit opposite to the extended pad. The clearance between the internal diameter of the casing and the outside diameter of the drill bit 28 controls the extension of the pad 16.

The sleeve has a locking mechanism that is inserted into the side of the main body 12 and provides the means of locking the pad 16 for orientation. As will be described hereinafter, the locking assembly includes a rod, a spring, a flipper, and a retaining housing. In order for the rod to be pushed into the hole of the sleeve, the spring must be compressed. The spring rate/strength is determined by inputting certain factors in a MathCad program prior to drilling the well. The flipper is fixed in the mudflow through the interior passageway of the main body. When the mudflow rate is increased at the surface by pumping, a force is applied to the exposed area of the flipper to a point were the force overcomes the spring rate and allows the flipper to rotate out of the mudflow so as to push the rod into the hole of the sleeve adjacent to the extended pad 16. The drill string 24 will be rotated a few revolutions to confirm that the rod is inserted into the hole. Since the MWD tool is aligned with the rotary steering apparatus 10 opposite to the rod, this arrangement will give the push in the desired direction. Once the tool is oriented, the rate of mudflow will be reduced so as to cause the compressive spring force to overcome the force created by the mudflow on the flipper. The rod will retract out of the hole into the original position and drilling will continue.

Figure 2:
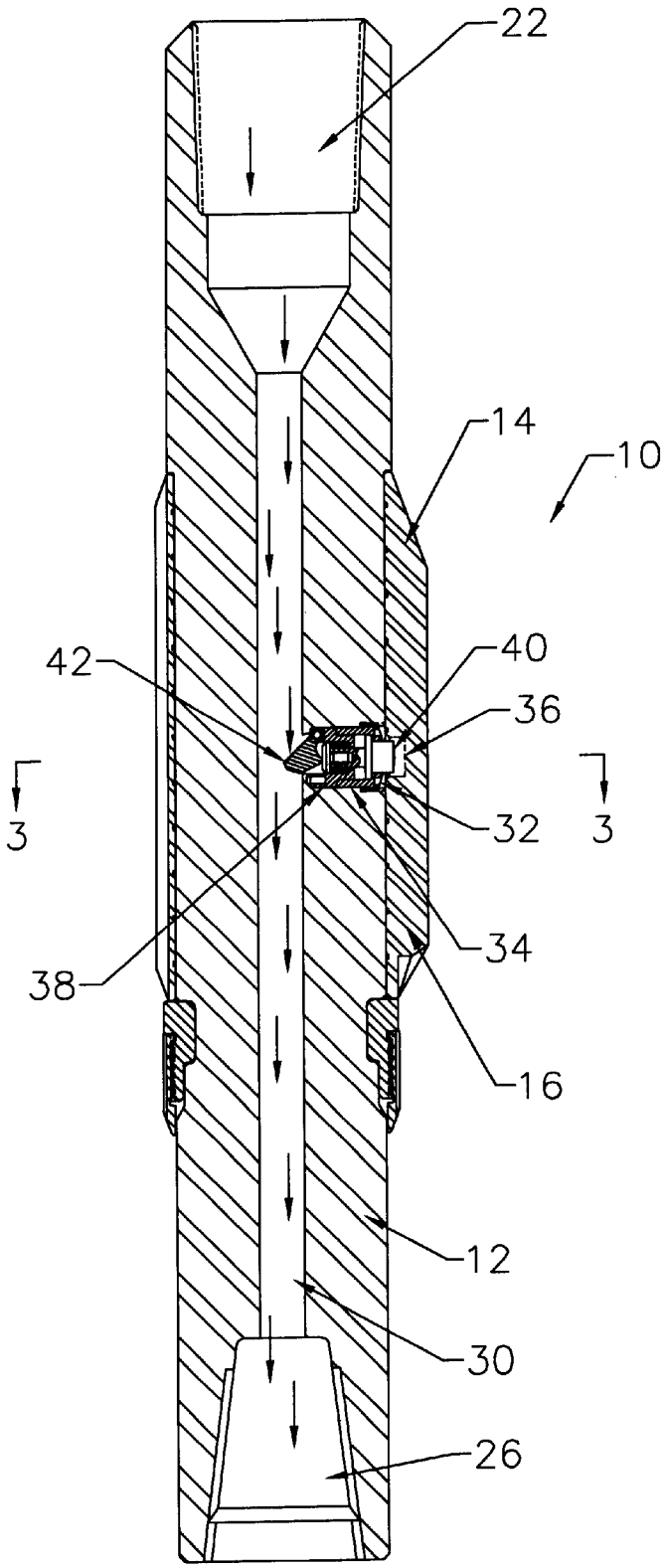
FIG. 2 is a cross-sectional view showing the present invention in which the locking member is engaged with the sleeve.

Referring to FIG. 2, there is shown at 10 the rotary drilling apparatus in accordance with the preferred embodiment of the present invention. The rotary drilling apparatus 10 includes the main body 12 and the sleeve 14. An interior passageway 30 extends longitudinally through the main body. The arrows in FIG. 2 illustrate the direction of mudflow through the interior passageway 30. The main body 12 has a top end 22 which is suitable for being coupled to the drill string 24. The main body 12 has a bottom end 26 which is suitable for being coupled to the drill bit.

In FIG. 2, it can be seen that the locking mechanism 32 is positioned within a channel 34 formed in the main body 12 and extending radially from the longitudinal passageway 34. The channel 34 opens to the longitudinal passageway 30. The sleeve 14 has a hole 36 formed therein which faces the main body 12. The hole 36 is a machined hole formed on the interior surface of the sleeve 14.

It can be seen that a retaining housing 38 is affixed within the channel 34 of the main body 12. The retaining housing 38 will suitably retain the spring and the rod 40 therein. Importantly, it can be seen that a flipper 42 is pivotally connected to an end of the retaining housing 38 within the channel 34. The flipper 42 has a surface which extends outwardly from the channel 34 into the longitudinal passageway 30. The surface of the flipper 42 will extend into the flow pathway of mudflow within the longitudinal passageway 30. The spring within the retaining housing 38 will have a suitable resiliency so as to cause the flipper 42 to extend outwardly into the interior passageway 30 during normal operations. However, when mudflow through the longitudinal passageway 30 is increased, the flipper 42 will move downwardly, overcoming the spring rate (or strength) of the spring so as to cause the rod 40 to extend outwardly of the channel 34 and into the hole 36. As such, this movement of the rod 40 will cause the main body 12 to lock onto the sleeve 40 so as to prevent free rotation of the main body 12 with respect to the sleeve 14. A rotation of the main body 12 will cause the sleeve 14 to similarly rotate so that the position of the protruding pad 16 can be moved to a different position for the purpose of bearing against the wall of the borehole 18.

Figure 3:
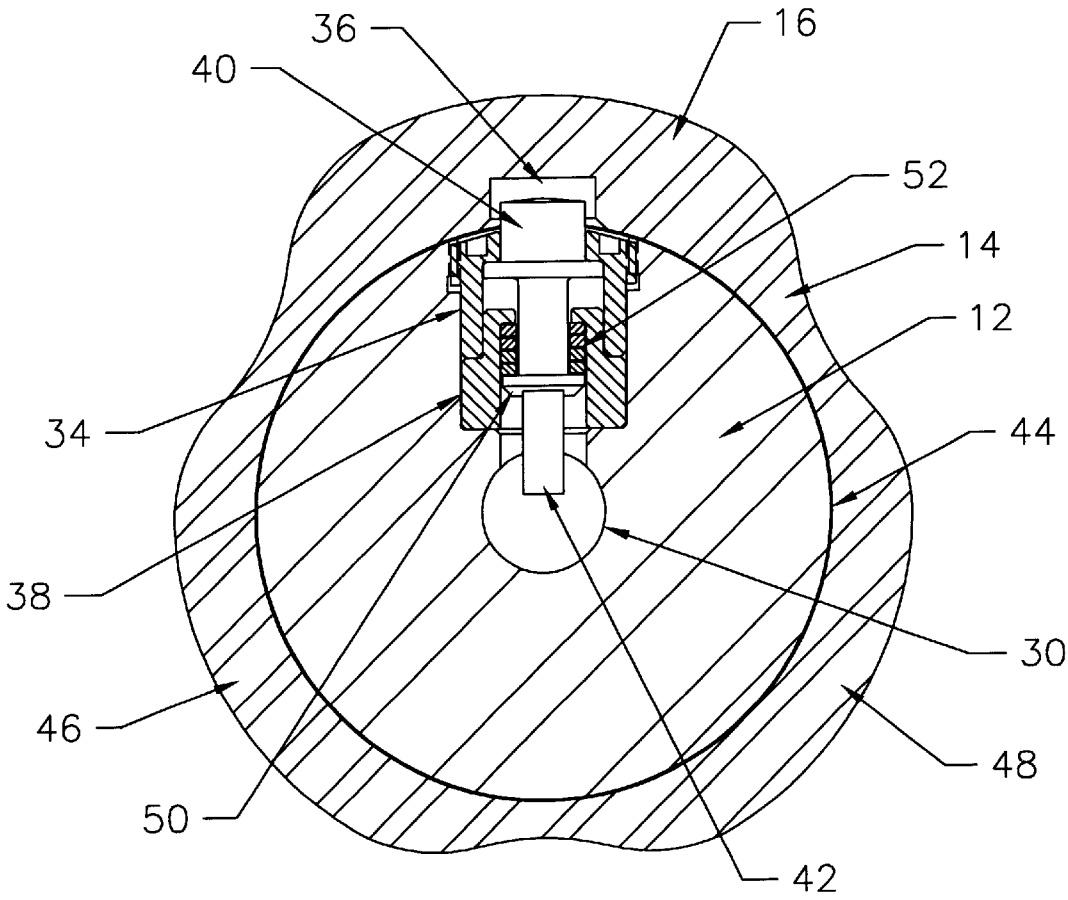
FIG. 3 is a plan view taken across lines 3—3 of FIG. 2.

FIG. 3 shows a plan view of the operation of the locking member. In FIG. 3, it can be seen that the main body 12 is positioned within an interior opening 44 formed in the sleeve 14. The sleeve 14 has protruding pads 16, 46 and 48. Protruding pad 16 extends outwardly further from the main body 12 than either of the protruding pads 46 and 48. Each of the protruding pads 16, 46 and 48 are spaced an equal distance from each other. The hole 36 is formed so as to align with the center of the protruding pad 16. The hole 36 is shown as opening to the interior opening 44 of the sleeve 14 and facing the main body 12.

In FIG. 3, the interior passageway 30 is shown as located in the center of the main body 12 so as to allow for the passage of mudflow therethrough. The flipper 42 extends outwardly into the interior passageway 30. The flipper 42 is pivotally connected to the retaining housing 38 located within the channel 34 of the main body 12. A locking pin tip 50 is secured to the locking rod 40. Spring 52 is compressively positioned between the interior shoulders of the retaining housing 38 and the interior shoulders of the locking pin tip 50. The spring 52 has a predetermined spring rate/strength. As such, it will be known the rate of mudflow that is required so as to cause the flipper 42 to overcome the spring rate of the spring 52 and cause the flipper 42 to act on the locking pin tip 50 for the sliding movement of the rod 40 outwardly of the main body 12 and into the hole 36 of the sleeve 14.

Figure 4:
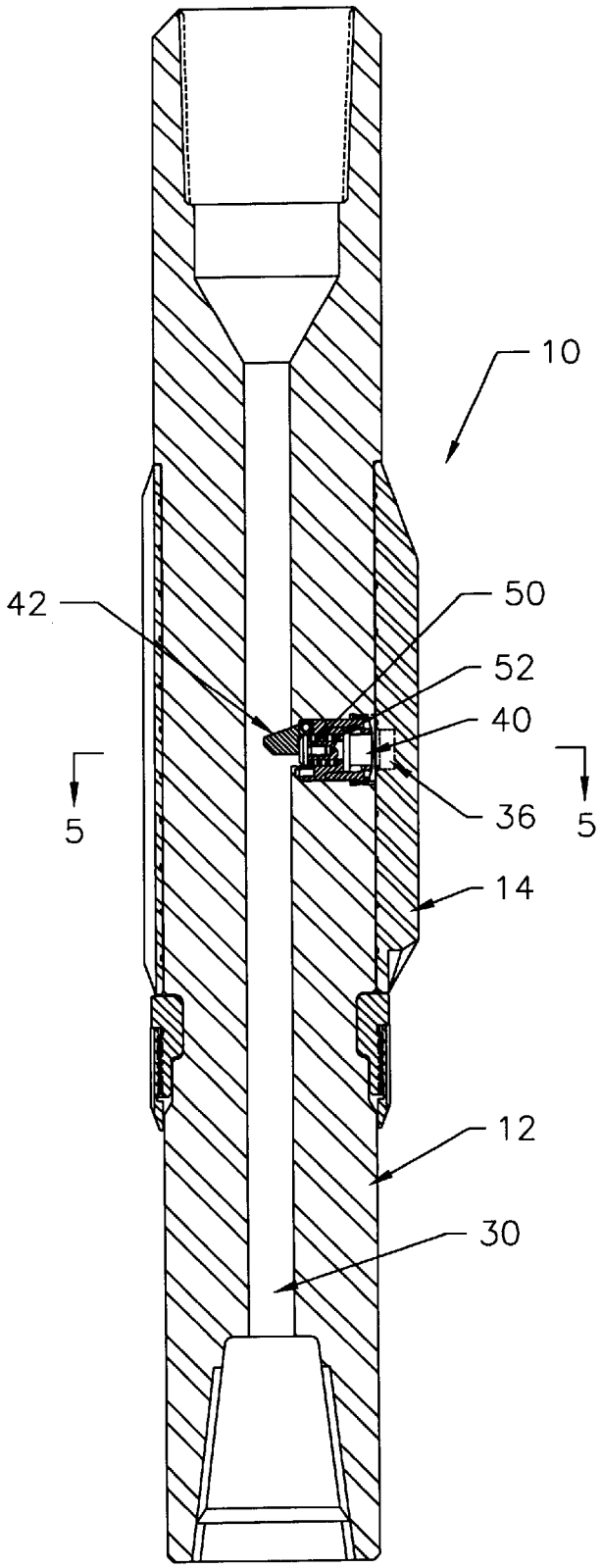
FIG. 4 is a cross-sectional view showing the present invention which the sleeve is released from the main body.

In FIG. 4, the apparatus 10 is shown with the rate of mudflow through the interior passageway 30 is reduced such that the flipper 42 extends fully inwardly into the longitudinal passageway 30. In this arrangement, the spring 52 has minimal resistance so that the locking pin tip 50 pushes the flipper 42 outwardly and the spring 52 causes the locking pin tip 50 to move the rod 40 outwardly of the hole 36. In this position, the sleeve 14 is released from its locked engagement with the wall of the main body 12. As a result, the main body 12 is freely rotatable relative to the sleeve 14.

Figure 5:
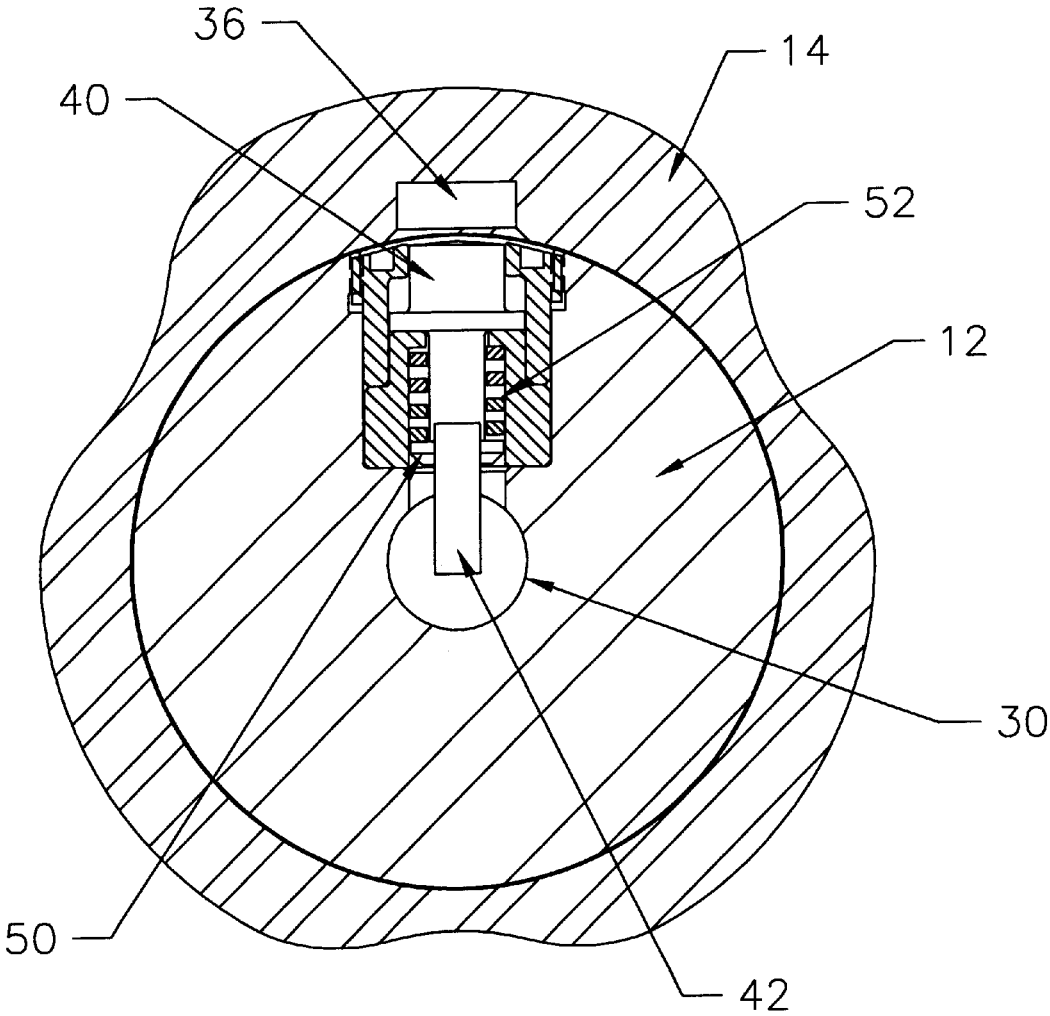
FIG. 5 is a cross-sectional view taken across lines 5—5 of FIG. 4.

In FIG. 5, the removal of the rod 40 from the hole 36 is particularly illustrated. It can be seen that the flipper 42 extends further inwardly into the longitudinal passageway 30 of the main body 12. Spring 52 is no longer compressed but is fully extended so as to cause the locking pin tip 50 to urge the flipper 42 outwardly. The movement of the locking pin tip 50 toward the longitudinal passageway 30 will cause the rod 40 to retract from its engagement with the hole 36. As a result, the sleeve 14 is released from its engagement with the main body 12 so that the main body 12 can rotate freely with respect to the sleeve 14.

Figure 6:
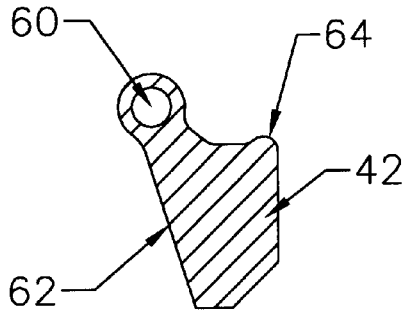
FIG. 6 is an isolated view of the flipper as used in the present invention.

FIG. 6 is an isolated view of the flipper 42. The flipper 42 has a pivotal connection 60 which allows the flipper 42 to be pivotally connected, by a pin, to the retaining housing 38. The flipper 42 has a surface 62 which is suitably flat and configured so as to encounter the mudflow extending through the longitudinal passageway 30. Surface 42 will be directly interactive with the mudflow. An abutment surface 64 is formed on the flipper 42 so as to be suitable for direct contact with the locking pin tip 50. The downward pivotal movement of the surface 62 will cause the abutment surface 64 to act on the outer surface of the locking pin tip 50.

Figure 7:
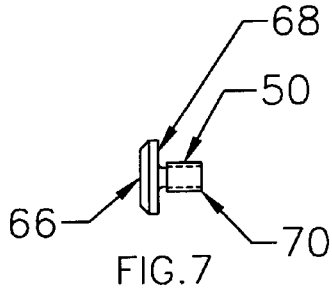
FIG. 7 is a side elevational view of the lock pin tip as used in the present invention.

FIG. 7 shows this locking pin tip 50. Locking pin tip 50 has an outer surface 66 which will be in contact with the abutment surface 64 of the flipper 42. An inner shoulder 68 will be in contact with the end of the spring 52. The end 70 of the locking pin tip 50 opposite the surface 66 will be securely affixed into an end of the rod 40.

Figure 8:
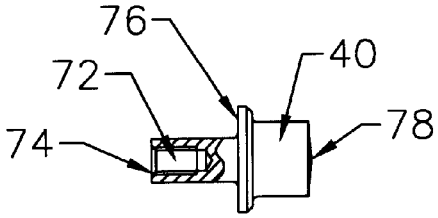
FIG. 8 is a side elevational view in partial cross-section of the rod as used in the present invention.

Rod 40 is illustrated in FIG. 8. Rod 40 includes an orifice 72 at end 74 suitable for receiving the end 70 of the locking pin tip 50. When the locking pin tip 50 is engaged with the rod 40, the movement of the locking pin tip 50 will cause a corresponding movement of the rod 40 and vice versa. The rod 40 has an interior shoulder 76 which will be located within the retaining housing. The rod 40 has an end 78 of a suitable size so as to engage the hole 36 associated with sleeve 14.

Figure 9:
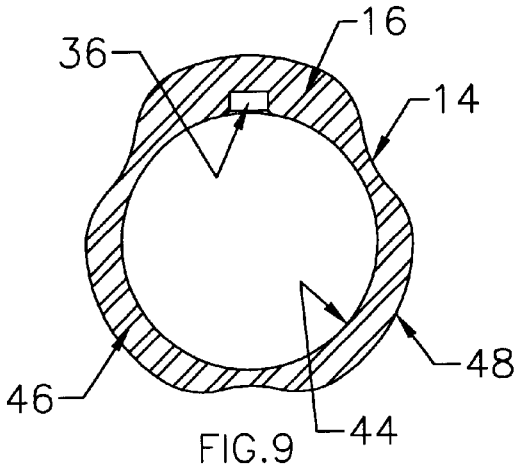
FIG. 9 is an isolated plan view of the sleeve as used in the present invention.

FIG. 9 shows a cross-sectional view of the sleeve 14. In particular, it can be seen that the interior opening 44 has a configuration whereby the main body 12 can extend thereto. The sleeve 14 should be freely rotatable relative to the main body 12 when the locking member is not engaged with the hole 36. The protruding pads 16, 46 and 48 extend outwardly of the sleeve 14.

Figure 10:
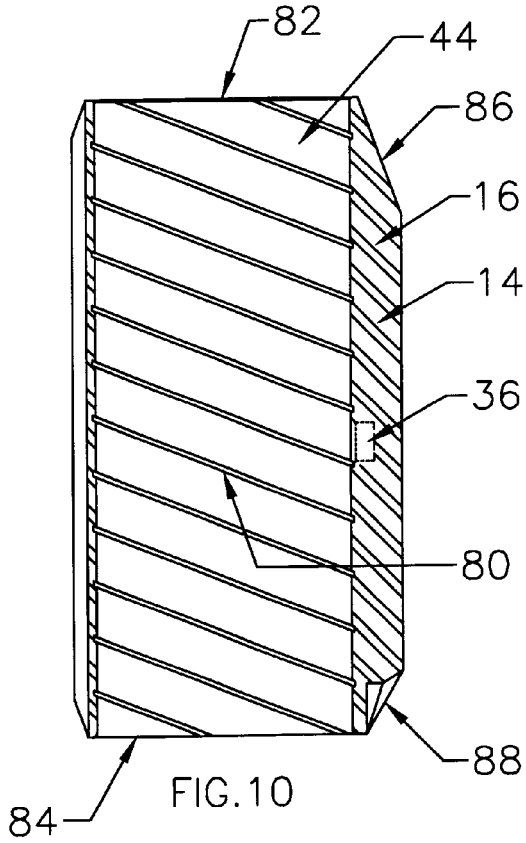
FIG. 10 is a cross-sectional view of the sleeve as used in the present invention.

FIG. 10 shows an isolated cross-sectional view of the sleeve 14. Helical grooves 80 are formed in the interior opening 44 of the sleeve 14. The hole is positioned midway between the top 82 and the bottom 84 of the sleeve 14. The protruding pad 16 is tapered along outer edges 86 and 88 so as to facilitate movement within the borehole.

Figure 11:
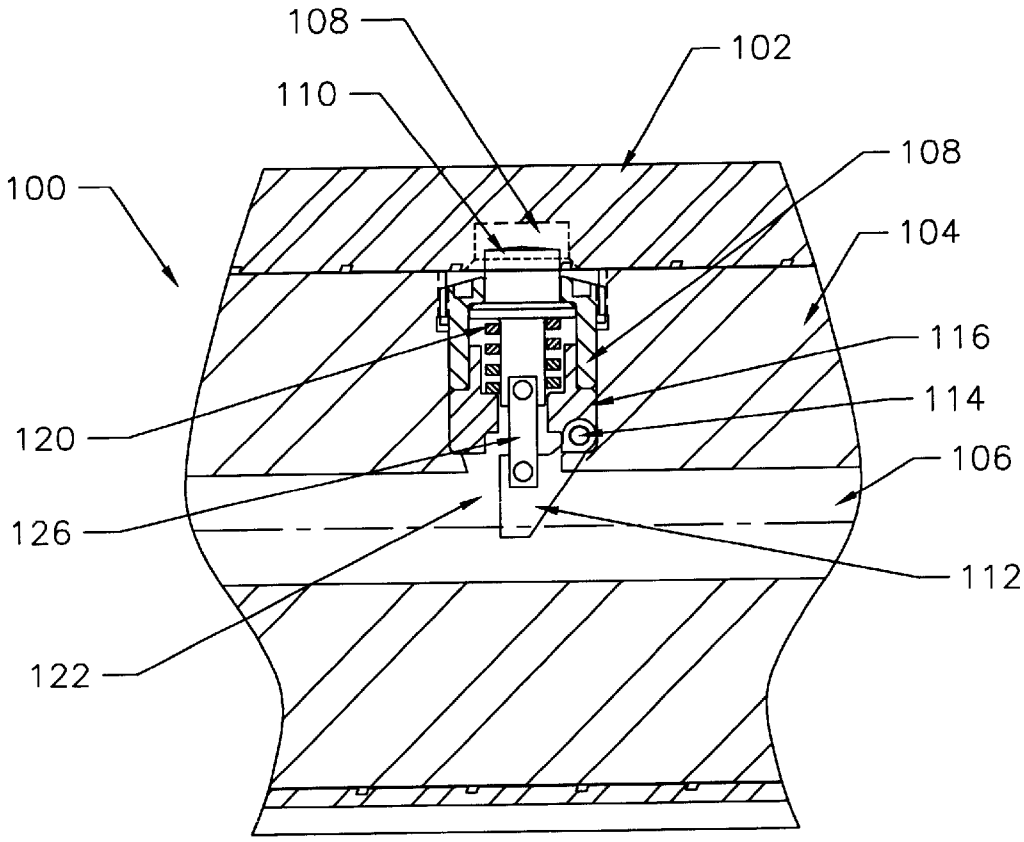
FIG. 11 is a cross-sectional view of an alternative embodiment of the present invention in which the locking member is engaged with the sleeve.
Figure 12:
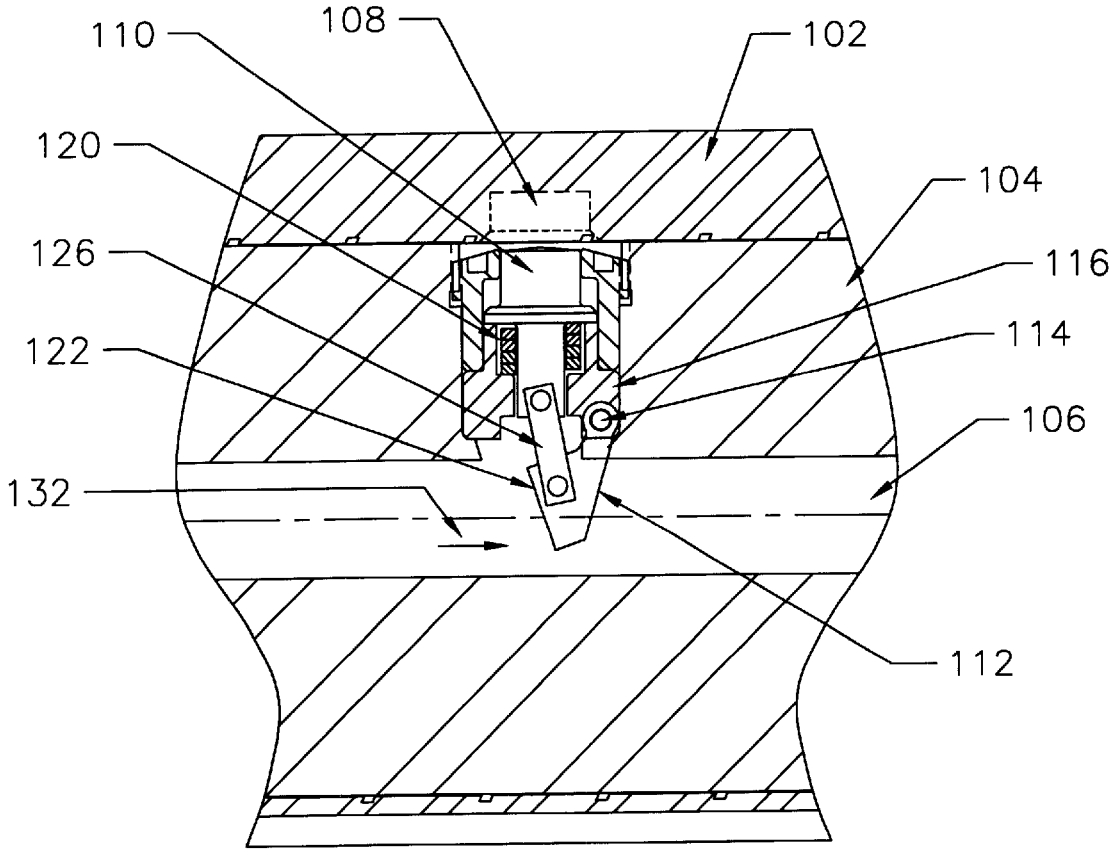
FIG. 12 is a cross-sectional view of the present invention in which to sleeve is released from the main body.

FIGS. 11 and 12 show an alternative form of the present invention wherein the sleeve is locked onto the main body when mudflow through the interior passageway is reduced and uses increased mudflow so as to lock the sleeve onto the main body. This alternative embodiment 100 is particularly useful in coil tubing applications.

Referring to FIG. 11, it can be seen that the sleeve 102 extends around the main body 104 in the manner of the previous embodiment of the present invention. Interior passageway 106 extends longitudinally through the main body 104. A channel 108 is formed in the main body 104 and extends radially therethrough from the interior passageway 106 toward the sleeve 102. The sleeve 102 has a hole 108 formed therein. Hole 108 is suitable for receiving rod 110 when the mudflow is reduced.

In the alternative embodiment 100, the flipper 112 is pivotally mounted at pivot point 114 to the locking mechanism 116. The flipper 112 also has a cantilever pivoting point 118 on the flipper 112 and a connection to the locking mechanism 116. Spring 120 is positioned within the locking mechanism 116 so as to resiliently urge the flipper 112 to have a surface 122 extending outwardly into the interior passageway 106.

When the mudflow through the interior passageway 106 is unable to overcome the resistance offered by the spring 120, the flipper 112 will pivot about its pivot point 114 upwardly. This will cause the cantilever arm 126 to urge the rod 110 outwardly and into the hole 108.

FIG. 12 shows how the rod 110 is released from the hole 108 when the mudflow through the interior passageway 106 is increased. When the mudflow is increased traveling in the direction of arrow 132 within the interior passageway 106, a pressure is applied to the surface 122 of flipper 112. This will cause a downward pivotal motion about the pivot point 114. As a result, the cantilever arm 126 will suitably pivot so as to cause the rod 110 to move back inwardly into the retaining mechanism 116 and out of the hole 108. In this position, the spring 120 will be suitably compressed within the interior of the retaining mechanism 116. As a result, the main body 104 can be adjusted relative to the sleeve 102 in the manner described herein previously.

The present invention provides a simpler more reliable rotatable steering system that permits complete directional control. In the prior art, the various directional controls on the drilling systems are quite complex and are of high cost. In spite of the complexity of the systems, the practical benefit of these systems is limited. The present invention is a more practical system of a simpler design. The present invention is a design which is more reliable while operating under the rigors of the drilling environment. Although simple, the present invention yields practical benefits to the operator equal to, or even exceeding, those derived from existing systems. The present invention provides a lower cost of the system equipment in the event that the downhole assembly should be lost in the well. The present invention avoids the chances of sticking the drill string.

The present invention has the unique capability of selectively replacing or integrating a mud-motor. As in the case of other systems in use today, the rotary steering apparatus will be able to replace conventional mud-motors, allowing the rotary action of the drill string to drive the bit. The use of a high performance mud-motor working in conjunction with the rotary steering apparatus of the present invention can result in significant benefits. A mud-motor can supply torque and rotational speed controlled by fluid flow independent of the drill string rotation. Drill string rotation and mud-motor power can be optimized for varying conditions.

The present invention avoids the use of battery-powered electronics. The rotary steering apparatus permits the use of retrievable MWD systems without compromise in function. The rotary steering apparatus allows the selective use of a mud-motor to enhance drilling capability. The apparatus of the present invention is as compact as possible to minimize the distance between the bit and the desirable near-bit sensors. Stabilizer pads that protrude against the borehole wall provide the steering capability. The desired build angle can be set by a pad protrusion adjustment at the surface prior to entering the well. Orientation of the rotary steering apparatus can be accomplished by allowing a swivel lock in the change position only. The tool can be positioned by drill string rotation while in this locked position.

The foregoing disclosure and description of the invention is illustrative and explanatory thereof. Various changes in the details of the illustrated claims may be made within the scope of the appended claims without departing from the true spirit of the invention. The present invention should only be limited by the following claims and their legal equivalents.

I claim:

1. A rotary steering apparatus comprising:

a main body having an interior passageway extending longitudinally therethrough;

a sleeve extending around said main body such that said main body is rotatable within said sleeve, said sleeve having at least one protruding pad extending outwardly of an exterior surface thereof; and a locking member affixed in said main body, said locking member engageable with said sleeve relative to a flow rate of fluid through said interior passageway of said main body such that said sleeve is fixed relative to said main body.

2. The apparatus of claim 1, said main body having a drill string connection at a top end thereof and a drill bit connection at a bottom end thereof.

3. The apparatus of claim 1, further comprising:

a drill string connected to one end of said main body; and a drill bit connected to an opposite end of said main body.

4. The apparatus of claim 3, said drill string being drivingly connected to said main body so as to rotate said drill bit.

5. The apparatus of claim 1, said sleeve having an interior opening, said main body extending through said interior opening, said sleeve having a hole formed therein and opening to said interior opening, said locking member engageable with said hole.

6. The apparatus of claim 5, said hole being radially aligned with said protruding pad.

7. The apparatus of claim 6, said sleeve having three protruding pads formed on an exterior surface thereof, each of said protruding pads being evenly spaced from an adjacent protruding pad.

8. The apparatus of claim 7, one of said three protruding pads extending outwardly further from said exterior surface than the other of said protruding pads, said hole being aligned with said one of said protruding pads.

9. The apparatus of claim 1, said locking member comprising:

a flipper extending pivotally into said interior passageway;

a spring connected to said flipper so as to resiliently urge said flipper inwardly into said interior passageway; and a rod connected to said flipper so as to move in correspondence with a pivotal movement of said flipper, said rod engageable with said sleeve so as to fix said sleeve to said main body such that said sleeve rotates correspondingly with a rotation of said main body.

10. The apparatus of claim 9, said main body having a channel extending transverse to said longitudinal passageway and opening thereto, said sleeve having a hole formed therein and facing said main body, said rod being movable so as to engage said hole.

11. The apparatus of claim 10, further comprising:

a retaining housing affixed within said channel, said flipper being pivotally connected to said retaining housing, said spring positioned within said retaining housing, said rod extending through said retaining housing so as to face said sleeve.

12. The apparatus of claim 10, said rod having a diameter less than a diameter of said hole, said flipper urging said rod outwardly of said retaining housing so as to enter said hole.

13. The apparatus of claim 9, said spring having a predetermined spring rate, said flipper being interactive with said spring such that a desired mudflow rate causes said flipper to overcome said spring rate so as to urge said rod outwardly of said main body.

14. A method of steering a drill bit in a well bore through the use of a drill string, the method comprising:

forming a main body rotatable within a sleeve, said sleeve having at least one protruding pad formed on an exterior surface thereof, said main body having an interior passageway with a flipper pivotally mounted and extending thereinto;

attaching said main body to the drill bit and to the drill string;

pumping a fluid through said interior passageway so as to depress said flipper to fix said sleeve relative to said main body;

rotating said main body and said sleeve so that said protruding pad moves to a desired position within the well bore;

reducing fluid flow through said interior passageway such that said flipper releases said main body from said sleeve; and rotating the drill string and the main body and the drill bit independently of said sleeve.

15. The method of claim 14, said step of forming further comprising:

connecting a spring to said flipper so as to resiliently urge said flipper into said interior passageway, said spring having a desired spring rate, said flipper being interactive with a rod facing said sleeve, said sleeve having a hole formed therein.

16. The method of claim 15, said step of pumping comprising:

pumping fluid at a desired rate through said interior passageway such that said flipper overcomes said spring rate of said spring so as to urge said rod into said hole of said sleeve.

17. The method of claim 16, said step of reducing fluid flow comprising:

pumping fluid at a rate less than said desired rate such that said spring urges said rod toward said flipper and out of said hole of said sleeve.

18. The method of claim 14, further comprising:

attaching a measurement-while-drilling instrument to said drill string adjacent said main body; and orienting said sleeve and said drill bit by rotating said drill string relative to information provided by said measurement-while-drilling instrument.

19. A rotary steering apparatus comprising:

a drill string;

a drill bit;

a main body connected at one end to said drill string and at another end to said drill bit, said main body having an interior passageway extending longitudinally therethrough;

a sleeve extending around said main body such that said main body is rotatable within said sleeve, said sleeve having at least one protruding pad extending outwardly therefrom; and a locking means affixed to said main body and interactive with said sleeve, said locking means for locking said sleeve relative to said main body such that said sleeve rotates correspondingly with a rotation of said main body, said locking means locking said sleeve to said main body relative to an increased flow rate of fluid through said interior passageway.

20. The apparatus of claim 19, said main body having a channel formed therein and extending radially from said longitudinal passageway, said sleeve having a hole formed therein and facing said main body, said locking means comprising:

a flipper pivotally connected to said main body so as to extend into said longitudinal passageway;

a spring resiliently connected to said flipper so as to urge said flipper into said interior passageway; and a rod interactively connected to said flipper and extending within said channel, said rod movable so as to engage said hole when the increased flow rate of fluid causes said flipper to overcome a spring rate of said spring and to push said rod outwardly of said channel.

* * * * *